US008763686B2

(12) United States Patent
Burgos

(10) Patent No.: US 8,763,686 B2
(45) Date of Patent: Jul. 1, 2014

(54) DOWNHOLE PACKER TOOL WITH ANTIFRACTURE MEANS

(75) Inventor: Horacio Daniel Burgos, Cipolletti (AR)

(73) Assignee: Texproil S.R.L. (AR)

( * ) Notice: Subject to any disclaimer, the term of this patent is extended or adjusted under 35 U.S.C. 154(b) by 323 days.

(21) Appl. No.: 13/185,442

(22) Filed: Jul. 18, 2011

(65) Prior Publication Data

US 2012/0160475 A1 Jun. 28, 2012

(30) Foreign Application Priority Data

Dec. 28, 2010 (AR) ..... P100104972

(51) Int. Cl.
*E21B 33/12* (2006.01)

(52) U.S. Cl.
USPC ..... 166/118; 166/134; 166/217

(58) Field of Classification Search
USPC ..... 166/118, 134, 217
See application file for complete search history.

(56) References Cited

U.S. PATENT DOCUMENTS

| | | | | |
|---|---|---|---|---|
| 5,086,839 | A * | 2/1992 | Setterberg et al. | 166/138 |
| 5,146,994 | A * | 9/1992 | Pleasants et al. | 166/387 |
| 5,542,473 | A * | 8/1996 | Pringle | 166/120 |
| 8,069,918 | B2 * | 12/2011 | Zimmerman et al. | 166/217 |
| 2002/0121160 | A1 * | 9/2002 | Bangert | 81/57.5 |
| 2007/0246227 | A1 * | 10/2007 | Ezell et al. | 166/387 |

* cited by examiner

*Primary Examiner* — William P Neuder
(74) *Attorney, Agent, or Firm* — Baker & McKenzie LLP

(57) ABSTRACT

A linkage device separate from the integrated slips bridge links the pair of spaced-apart members of each slip to prevent sizeable fractured bits from moving away in the event of a fracture in the slip. The linkage device comprises a pair of ductile steel bars the ends of which loosely anchor in holes in each slip member, the holes being located at both sides of the slips at opposite ends of a groove that houses the linkage bar preventing it from falling out of the holes. In this way, a fractured slip may continue to assist in setting the tool and, moreover, potential hazardous interference in further tool operations are avoided. Furthermore, tool damage including slips fracture is reduced by a resilient damper material which buffers the lower cone as it slides down on the slip-holder cage during a tool release operation.

21 Claims, 8 Drawing Sheets

DOWNHOLE PACKER TOOL WITH ANTIFRACTURE MEANS

PRIOR RELATED APPLICATIONS

This patent application claims the benefit of the priority of Argentine patent application serial number P100104972 filed on 28 Dec. 2010.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

Not applicable.

BACKGROUND OF THE INVENTION

The present invention concerns tools for borehole applications, in particular oil wells, gas wells or water-wells, more particularly including installations for primary, secondary or tertiary oil production, whether holes for injecting water, gas or another pressurizing agent (injector holes) or oil extraction (production wells). A particular application of the tool is in injector and producer multi-zone wells where the number of isolation zones is high and/or the wellbore casing is damaged or diverted, to quickly and economically isolate areas with damaged casing.

The present invention applies to tools carrying a packer device comprising seals mounted to a mandrel and forming with other operational components a tubing string (or just "tubing") of tools and components joined one after another for lowering down a multifunctional (or multizonal) well, i.e., having multiple layers or strata which should be isolated from one another. Packer tools are not unusual in the oil industry. The tubing string comprising a number of function-specific tools is lowered into a well, maintaining an annular space between and a well casing.

Packer tools generally comprise two basic elements: packer seals for isolating annular regions thereabove and below and anchor slips to affix the tool to a point of the casing. A packer sealing element is a ring made of metal and typically dense synthetic rubber that fits around the tubing in a well. The packer seal (the "packing element") of a packer tool (the "packer") is typically a rubber ring that expands against the side of the casing lining the side of the wellbore. A packer may, and usually will, have more than one packing element. In the majority of active wells in the world today, this tubing is used to either produce oil or gas out of the well and serve as a conduit to transport water into the well for water injection and water flood applications. The packer provides a secure packer seal between everything above and below where it is set. The main reasons for using a packer are to keep sediment, sand and other potentially corrosive or erosive materials from flowing into the annulus and damaging the casing, and to control the zone of the well from which hydrocarbons are being produced in a producer well or to control the zone where water is being injected in an injection well.

Slips hold the packer in place and prevent them from moving once they are set in the well. A slip is a serrated piece of metal that grips the side of the casing. Some packers lack a specific anchor device (in which case they are known as packer-tandems).

Insofar the present invention, the packer tool sequentially carries out the following phases:

Run-in: The tubing enters the well and the packer is lowered down to a set position.

Setting: Both the anchor slips and the packer seals are pushed outwards to respectively clamp the tool to the well during all the time the tubing stays down the well and isolate annular regions above and below the packer. The tool setting system may be mechanical, involving rotation or axial compression or traction, or else hydraulic by injecting a pressurizing fluid.

Release: This operation is carried out on removable tools to unset them from the well casing in order that they may be extracted. In tools having release systems, known as removable packers, release may be based on similar maneuvers or a combination thereof. Tools lacking a release system are known as permanent packers which need to be rotated to literally destroy the tool by machine milling. This operation is costly and time-consuming.

Extraction: The removable packer is hauled up to the mouth of the well.

The invention particularly relates to a packer tool that is removable, hydraulically set and mechanically released.

The present invention concerns the packer tool anchor means to the well casing wall by means of a dual-grip anchor device having bidirectional anchor slips, more precisely, the structural integrity of the anchor slips.

Use of mechanically- or hydraulically-actuated packer tools or, simply, packers for maintaining separation between production layers or fluid injection layers is well known in the oil industry.

The best known release systems are by rotation and traction. In the first system, the tool is released by rotating it several turns, which complicates the operation the deeper the well because of the greater number of tools. This in turn makes the operation unreliable through uncertainty regarding which tool is actually being operated.

In traction release, tractive tension is applied to the piping to shear a number of brass or steel pins. Once set, this kind of tool is subject to stress from temperature and pressure variations down the well, which get worse with increased depth to the point that pins may shear producing accidental tool release.

Also known in the art is to provide packer tools with an anchor device to affix the tool to the well casing wall for the duration in which the tool will remain inside the well for operations. U.S. Pat. No. 4,156,460 discloses a removable packer with two sets of separate sets of slips teeth with a seal device in between. Each set comprises four anchor slips at 90° from one another around mandrel. The upper set has its teeth facing upwards to selectively anchor the tool against upwardly movement whereas the teeth of the lower anchor slips face down in the opposite direction to selectively hold the tool against downwardly movement. Each set is engaged by its own actuator cone.

CA patent 2,286,957 illustrates the known concept of integrating the teeth of anchor slips in pairs, each pair consisting of one set of teeth directed against upward movement and another set of teeth directed against movement downwards, arranged side-by-side as a unit on a single piece, forming four anchor slips pieces which protrude through respective rectangular windows cut out in a cage, so as to share a single actuator cone. Moreover, this '957 CA patent suggests arranging the anchor slips at opposite ends of each anchor unit such that each anchor piece comprises an upper teeth member and a lower teeth member rigidly joined by a bridge forming part of the same unit.

This arrangement, which is also adopted in my prior AR patent publication 53,432 A1, is currently preferred and used in the present invention since it simplifies construction and operations. However, since the components of these types of tools frequently operate in extreme mechanical and thermal conditions, the anchor slips units are not free from becoming fractured during the tool run-in and dwelling time down a well.

The fracture of an anchor slip, aside from meaning potential problems for setting the tool, may also produce metal bits and pieces which may interfere with the movement of tool members such as during release operations and jam tool recovery. Pieces having substantial sizes may break off from the slips. The chance that a broken piece may interfere or jam an operation increases with the size of the broken-off piece. Slips fractures may occur near the bridge of the slips unit where the material properties transition, such that sizeable pieces or even an entire member may break off.

Furthermore, anchor slips may suffer damage in a well when beginning a release operation by turning the tool so that the release cone moves downwards to make room for the anchor slips to retract. Cone descent follows rotation of snugs formed on the mandrel that were retaining cone in its initial position and may be violent since it is driven by the weight of the cone itself, that of the lower sub depending from the cone and, more importantly, the load of the lower tubing components hanging from the lower sub of the tool.

The short and fast descent of the cone ends abruptly when a step thereof strikes a step formed at the bottom of the cage. The subsequent jar is transmitted to the anchor slips in the same and may fracture them.

Slips fracture causes randomly sized bits and pieces to come apart. Such broken pieces may get wedged in the annular space between the casing and some part of the tool such as the casing, troubling later attempts to haul the tool up, or fall inwards making release incomplete.

AR patent publication 41,393 (Reumann) discloses using an elastic means as a damper in a tool having a packing-holder collar and a wedge-shaped slips piece.

BRIEF SUMMARY OF THE INVENTION

An object of the invention is to provide a packer applicable to tools with dual-slips and hydraulic setting to overcome the above-mentioned prior art problems, thereby providing a packer having simple and reliable setting and release systems, converting it into a highly desirable tool for installations with multiple packers, useful for selective water injection, selective oil production or gas lift.

A particular object of the invention is to reduce the probability that an anchor slip may fracture as a result of jarring of the cage mounting the slips and, what could be more important still, in the event that a slip should break, reduce the probability that bits that have broken off and become separated from the main slip piece may interfere with operations for releasing the tool or extracting the tool from a well. A further object is to enhance the capacity of a fractured slip to carry out an anchor function.

The present invention overcomes the problem of fractured slip bits breaking off and separating by means of a linkage device which is separate from the bridge integrated with the slip. The separate linkage device links the pair of spaced-apart slip members to keep them together in the event of a fracture of a substantial part of the slip. This safety system against fractures provides more reliability to setting the tool since it means that the fractured bits will not move apart but will assist in anchoring the slips to the casing.

The linkage device is preferably embodied by a pair of stainless steel bars which are each lodged in a respective groove formed in the opposite sidewall of the slip. The ends of the bars are bent at right-angles and loosely anchored in blind holes formed in each slip member, the grooves extending from one blind hole to the other. In the event that a sizeable bit of a slip member should fracture, the fractured bit remains anchored by the linkage bars, thereby staying in place. Although in such an event it is foreseeable that the setting capacity of the fractured slip will not be the same, in any case some grip capacity to the casing may be provided in this way with this low cost solution of simple construction which, furthermore, prevents timely and costly problems when the time comes to release the anchor slips and raise the tool up and out of the well.

According to another aspect, the present invention reduces the intensity of the jarring to which the slips-holder cage is subjected to on account of it being met by the lower cone travelling downwards at the beginning of the release process. This is achieved, and potential damage to the anchor slips avoided, by inserting a resilient material to form a buffer between two complementary steps respectively protruding from the lower cone and the cage to dampen the effect of the free-falling cone hitting the cage.

BRIEF DESCRIPTION OF THE DRAWINGS

The accompanying drawings help to convey features of the present invention and advantages thereof by means of a preferred embodiment. In the drawings:

FIG. 1A is a view half elevation and half axial-section of a preferred embodiment of a packer tool according to the present invention, in an initial position ready for run-in;

FIG. 2A is a magnified half-axial section view of the hydraulic mechanism of the packer tool of FIG. 1A with its chamber, piston and cylinder in the initial position for run-in;

In all the figures like reference numbers identify like tool parts.

DETAILED DESCRIPTION OF THE INVENTION

Figure 1A:
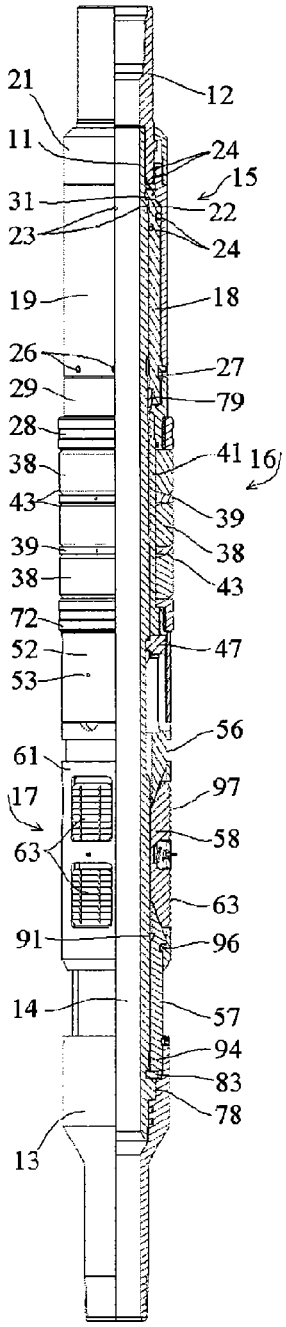
Figure 1B:
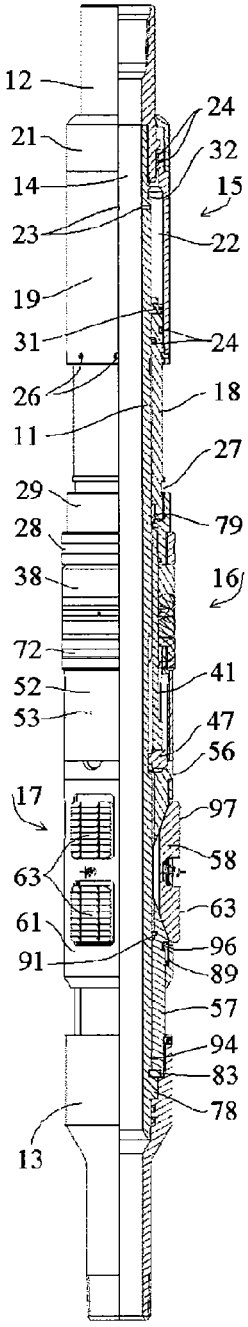
FIG. 1B is a view analogous to FIG. 1A but with the tool in the set position.
Figure 1C:
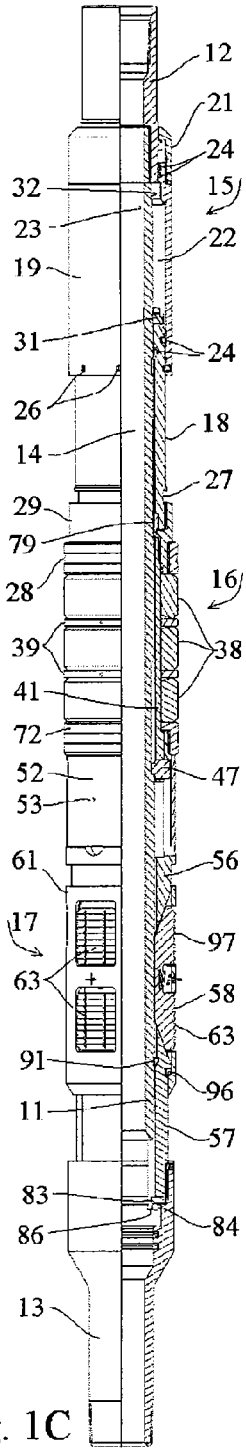
FIG. 1C is a view analogous to FIGS. 1A and 1B but with the tool in the released position, ready for extraction, after its mandrel has turned 60°.

A packer tool or "packer" having a nominal diameter of, e.g., 5½" (139 mm) is depicted in FIG. 1A (notwithstanding that the invention may encompass other standard tool sizes such as 7", 9⅝", etc.). The packer includes a mandrel 11 made of ASTM A519 steel type 4140-Y80 crowned, above, by an upper sub 12 and, below, by a lower sub 13. The three components 11, 12 and 13 are made of SAE 4140 tempered steel and, together, span a tool length of about 1.4 meters. A central bore 14 about 50.8 mm (2") in diameter axially traverses the mandrel 11.

The upper and lower subs 12, 13 are provided with threaded joints for connecting other tubing components above and below prior to the run-in operation. This arrangement allows torque to be transmitted down the length of the tool and, during run-in down a well, allows maneuvering of the entire tubing.

Figure 2A:
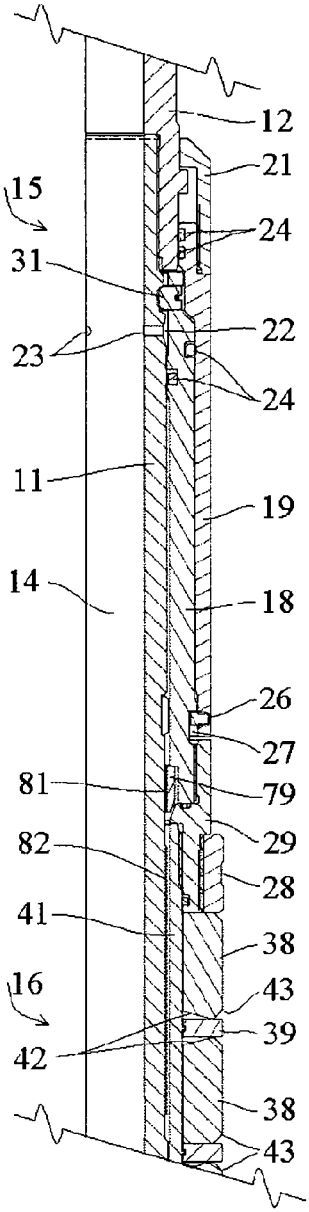
Figure 2B:
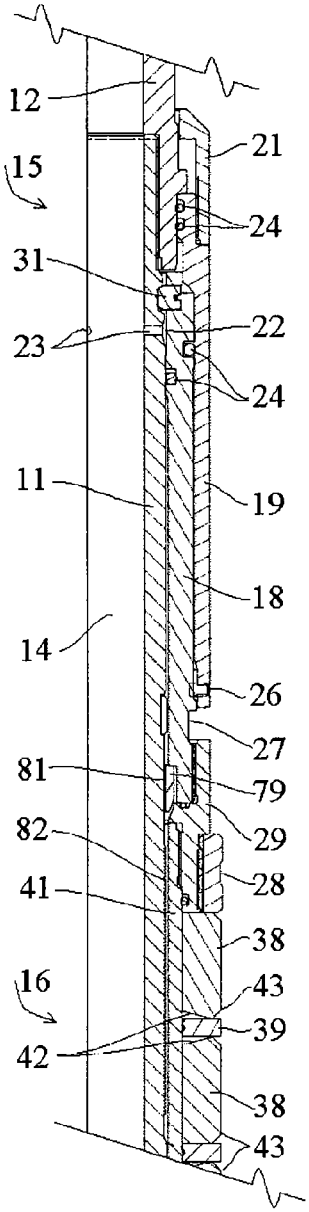
FIG. 2B is a magnified view analogous to FIG. 2A but wherein the safety device guarding against premature setting has been disabled during the transition to setting the tool.
Figure 2C:
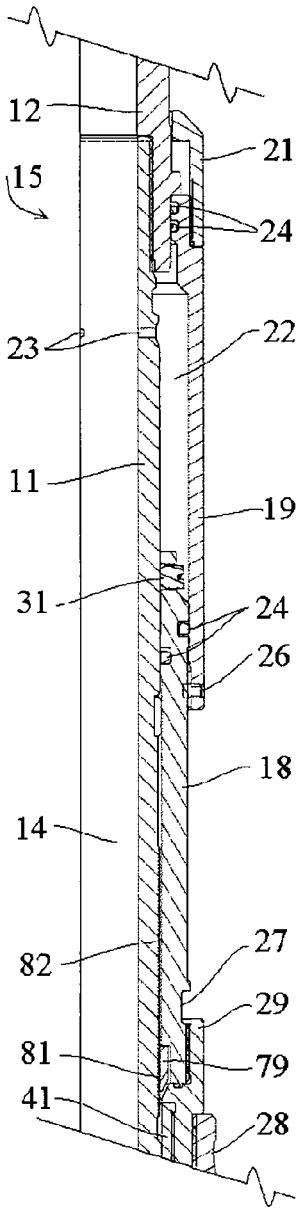
FIG. 2C is a magnified view analogous to FIGS. 2A and 2B but wherein the hydraulic mechanism has reached the final setting position and is stable.
Figure 3A:
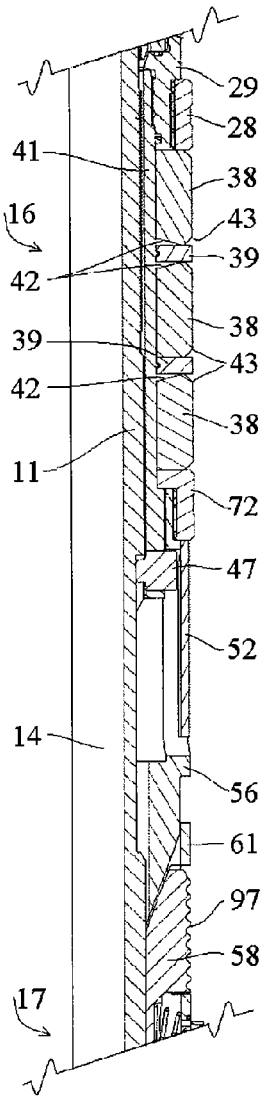
FIG. 3A is a magnified half-axial section view of the packing mechanism of the packer tool of FIG. 1A in the initial run-in position.
Figure 3B:
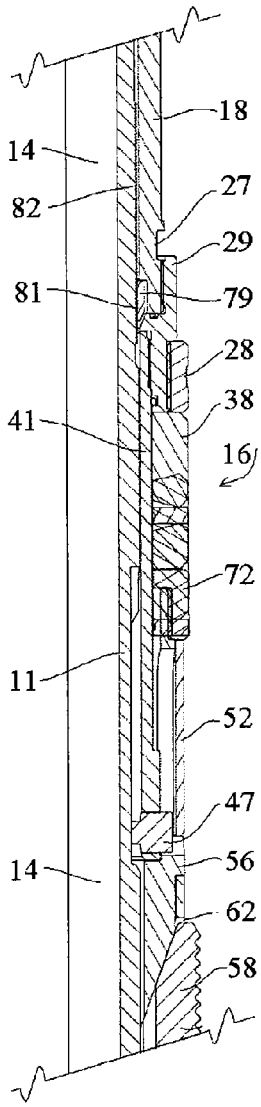
FIG. 3B is a magnified view analogous to FIG. 3A except that the packing mechanism is now in the set position.
Figure 3C:
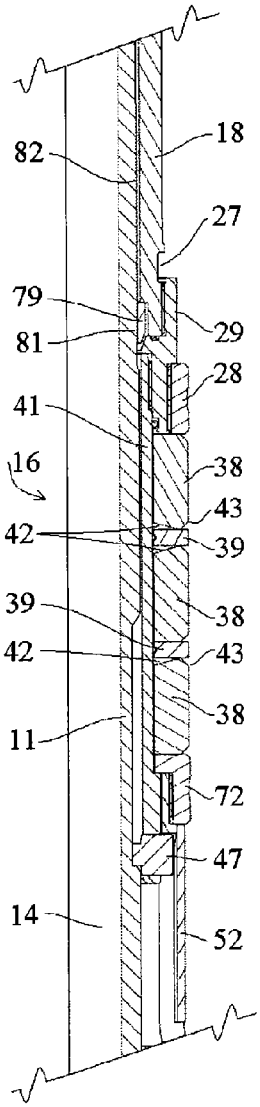
FIG. 3C is a magnified view analogous to FIGS. 3A and 3B but wherein the mandrel has been turned 60° to release the packing mechanism.
Figure 4A:
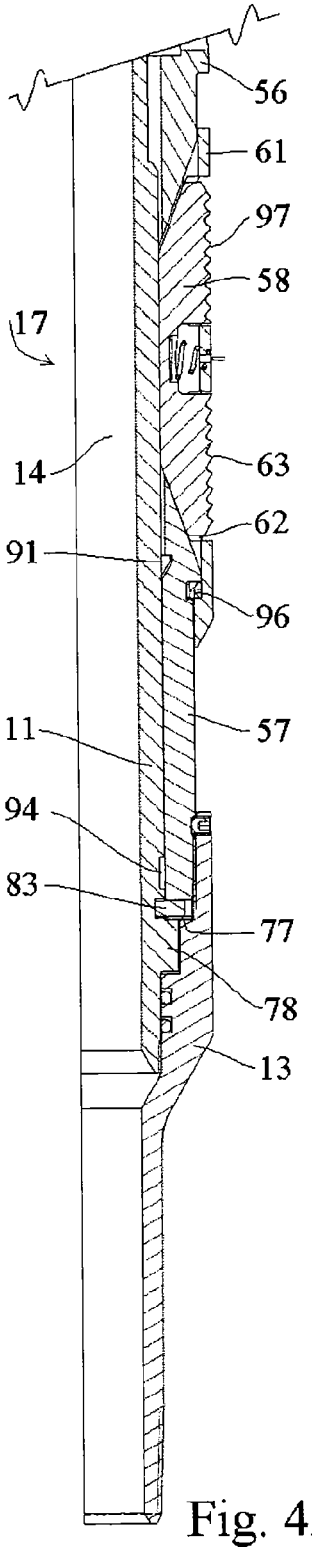
FIG. 4A is a magnified half-axial section view of the anchor mechanism of the packer tool of FIG. 1A in the initial run-in position.
Figure 4B:
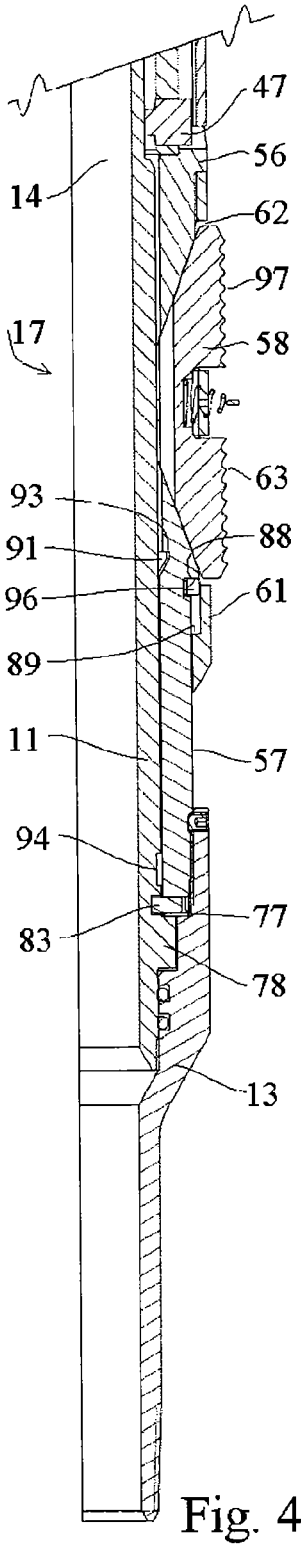
FIG. 4B is a magnified view analogous to FIG. 3A except that the anchor mechanism is now in the set position.
Figure 4C:
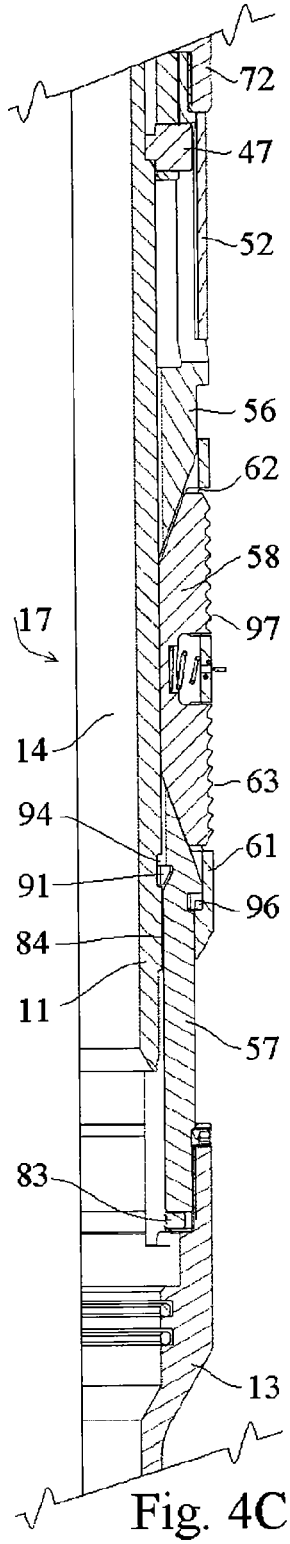
FIG. 4C is a magnified view analogous to FIGS. 3A and 3B but wherein the mandrel has been turned 60° as in FIG. 3C to release the anchor mechanism.

About the mandrel 11 and between the subs 12 and 13 the tool further includes, from top to bottom, a hydraulic mechanism 15 depicted in FIGS. 2A, 2B and 2C for setting the tool, a packing mechanism 16 depicted in FIGS. 3A, 3B and 3C for isolating well layers and an anchor mechanism 17 depicted in FIGS. 4A, 4B and 4C for keeping the tool affixed to a point in the well while it dwells therein.

The hydraulic tool setting mechanism 15 of FIG. 2A comprises a hydraulic piston 18 arranged around the upper part of the mandrel 11 to carry out a downward movement during the set operation. The piston 18 is surrounded by a hydraulic cylinder 19 at the top of which a hanger cap 21 is screwed on to prevent it from descending. The piston 18 functions as an actuator during the set operation, when in moves downwards to the position depicted in FIG. 2B to activate the packing and anchor mechanisms 16-17 as described further on hereafter.

A hydraulic chamber 22 is formed about the top of piston 18 to receive pressurized fluid for activating setting through passages 23 that communicate it with the central bore 14 of the mandrel 11. The hydraulic chamber 22 is closed in by the upper sub 12, the mandrel 11, the hydraulic cylinder 19, the piston 18 and packer seals 24.

Shear pins 26 screwed into the hydraulic cylinder 19 and penetrating through to a slot or depression 27 formed on the outer surface of the piston 18 convey reliability to the setting operation by preventing the latter from moving downwards in absence of sufficient hydraulic pressure in the chamber 22. To proceed with the set operation once the tool has been run-in down the well, fluid is injected at a predetermined pressure from the mouth of the well into the mandrel bore 14 such that it enters the radial passages 23 and fills the chamber 22. The effect of this pressure is to urge the piston 18 downwards to the position depicted in FIG. 2C as described further on herein, after shearing the threaded pins 26 which are dimensioned to said predetermined setting fluid pressure.

In this embodiment, the threaded pins 26 are made of brass, ¼" (6·35 mm) in diameter and the setting pressure is predetermined according to the number of threaded pins 26, e.g., 400 psi (2.8 MPa) per pin 26. The piston 18 and its threaded pins 26 are protected from damage by the hanger cap 21 during upward maneuvering of the tubing through zones of restricted diameter in the casing.

Figure 5A:
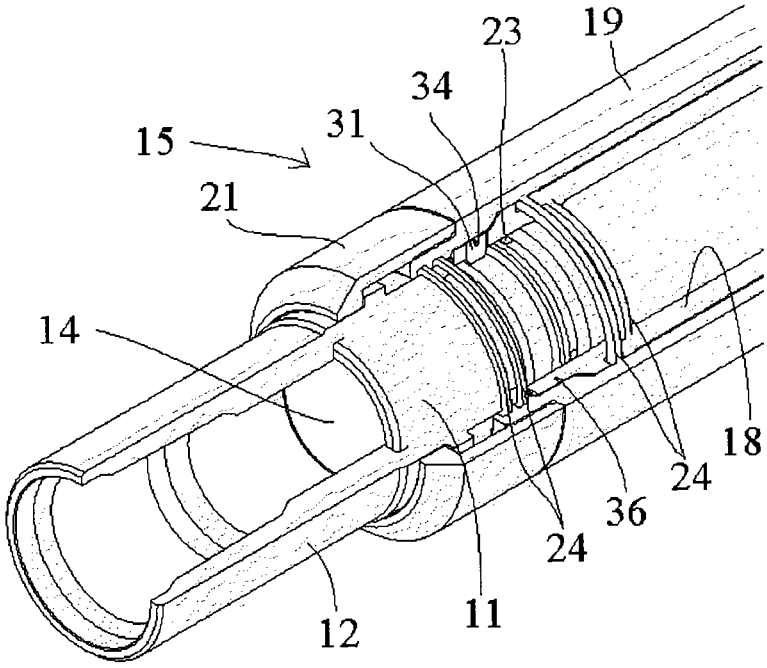
FIG. 5A is a perspective view of the hydraulic mechanism of the tool of FIG. 2A wherein a quadrant of the view has been removed to show the annular segments of the antisetting mechanism in place in their initial position.
Figure 6A:
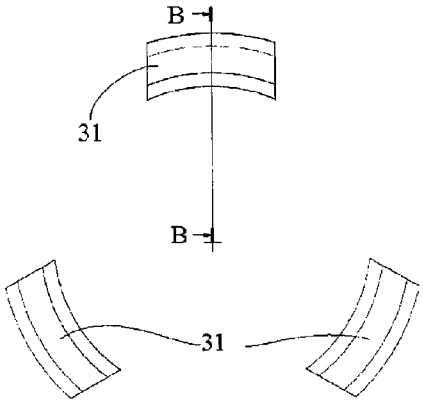
FIG. 6A shows the circumferential distribution of the annular segments which make up the antisetting safety mechanism of FIGS. 2 and 5 (alphabetic suffices are omitted from figure and reference numbers in the present description to indicate generalization), wherein some components such as O-rings have been omitted for the sake of clarity.
Figure 6B:
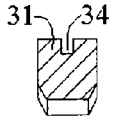
FIG. 6B is a cross-section of an annular segment of FIG. 6A.

However, I have seen that during run-in the pins 26 may be exposed to shear forces in absence of hydraulic pressure, caused by a calibrating ring 28 on a joining member 29 scraping or striking against the inner casing wall and transmitted up by the hydraulic piston 18 and the hydraulic cylinder 19. Shearing of the threaded pins 26 brings about the risk of the piston 18 prematurely sliding downwards and accidentally activating the packing and anchor mechanisms 16-17. This risk is avoided by means of an antisetting safety mechanism which prevents any downward movement of the piston 18 on the mandrel 11 in absence of the required setting activation hydraulic pressure. This safety mechanism is embodied by a ring segmented into three parts 31 arranged equicircumferentially in slots in the piston 18 as depicted in FIGS. 5A and 6A. FIGS. 6A and 6B show the preferred shape and proportions of these annular segments 31.

Figure 5B:
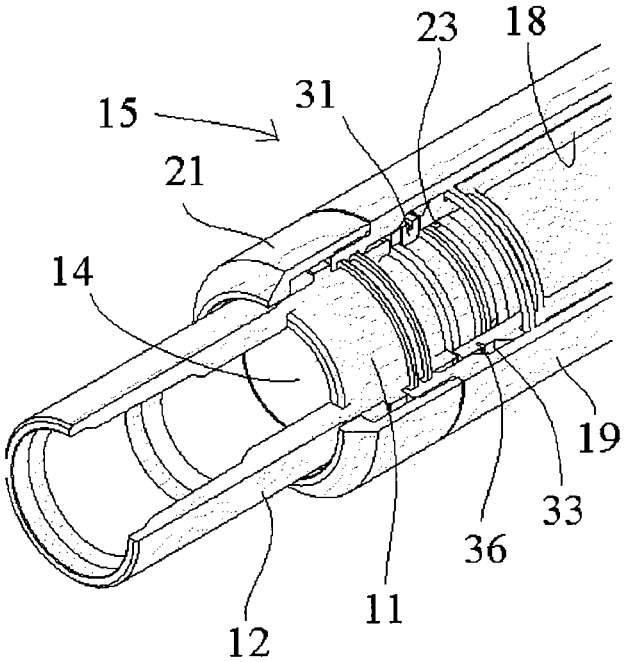
FIG. 5B is a perspective view analogous to FIG. 5A of the hydraulic mechanism of FIG. 2B showing relocation of the annular segments when setting is activated.

The annular segments 31 protrude radially inwards from the piston 18 fitting into a circumferential slot 32 formed on the outer wall of the mandrel 11 about 10 mm wide and chamfered edges as do the annular segments 31 too (more clearly visible in FIG. 6B) so as to retain the piston 18. At the same time, the hydraulic cylinder 19 acts as a "roof" that prevents the segments 31 from leaving the slots 32 in the mandrel 11. As a consequence, the piston 18 may not exert a force necessary to shear the threaded pins 26 to enable tool setting. The only way the segments 31 may leave the slot 32 and free the piston 18 is for the cylinder 19 to rise so that the complementary geometries of the cylinder 19 and the piston 18 create a space 33, as may be seen in FIG. 2B, sufficient for the segments 31 to leave the slot 32, as may be seen in FIG. 5B, and free the piston 18. However, the cylinder 19 may only budge by effect of the hydraulic pressure in the chamber 22, since the safety pins 26 prevent any undue ascent thereof. This segmented ring 31 system facilitates tool travel through zones of the casing where the diameter is restricted, without the tool setting prematurely.

The segmented ring 31 has a small circumferential notch 34 on its outer cylindrical surface and which continues around the intervening mandrel surface for a retainer ring 36 that softly maintains the annular segments 31 in place through the piston 18 and in the slot 32 when putting the tool together. It is an open ring 36 of relatively thin wire which easily yields and opens when pushed outwards by the annular segments 31 as soon as the latter are freed by the ascending cylinder 19. Suitable dimensions for the open ring 36 are about 1.75 mm in wire diameter, about 77.0 mm and about 80.4 mm inside and outside diameters, respectively, of the ring 36 and 5 mm separation between its open ends 37 when relaxed.

FIG. 3A shows the packing mechanism 16 comprising three rubber packer seals 38 made of NBR (Nitrile Butadiene Rubber) elastomer, separated by sliding spacer rings 39 and mounted to a seal-holder collar 41 which is engaged by the piston 18 via the joining member 29. The joining member 29 has a calibrating ring 28 screwed thereon to adjust the amount of deformation of the packer seals 38 into the annular space between the tool and the casing during the set operation. The section of the packer seals 38 includes a chamfered surface 42 which emerges first in response to pressure applied by the joining member 29, as FIG. 3B illustrates, so that a circumferential lip 43 makes first contact and continues to deform against the inner wall of the casing to form a hermetic seal. Once in the set position, the packer seals 38 remain pressed against the casing wall, blocking passage of fluids from one side to the other of the packing 38 in the axial direction of the well.

Figure 8A:
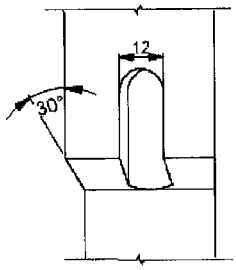
FIGS. 8A and 8B are respective section and plan views of one of the slots in FIG. 7.
Figure 8B:
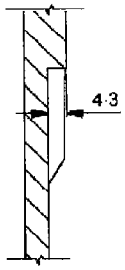
Figure 7:
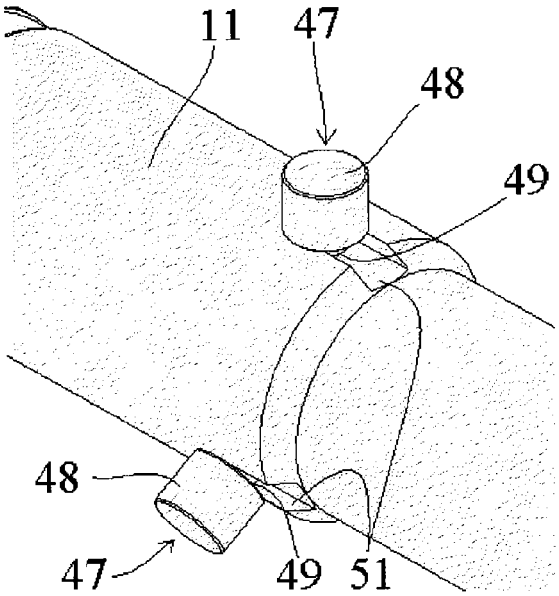
FIG. 7 is a magnified perspective view of part of the mandrel of the tool of FIG. 1 A showing two of the three anti-release safety pins located in their slots prior to the tool set position.

Three anti-release safety pins 47 are fitted in round holes 46 perforating the seal-holder collar 41. Each pin 47 is made of SAE4140 tempered steel and is formed with a cylindrical or slightly frustoconical stud 48 about 11.0 mm in diameter and about 4.5 mm length and a head 49 which is also cylindrical but larger both in length and section as FIG. 7 shows, measuring about 19.5 mm in diameter and about 15.5 mm long, forming a smooth piece which is highly resistant insofar it is dimensioned so that the head-stud 49-48 transition is be virtually unyielding to shear forces. The head 49 fits snugly in the round orifice 46 through the packing-holder collar 41 and the stud 48 in a respective longitudinal slot 51 machine-cut in the mandrel 11 as illustrated in FIGS. 8A and 8B. The slot 51 is about 29 mm long, about 12 mm across and about 4.3 mm high in the illustrated embodiment.

Since these pins 47 are smooth, a cylindrical cover 52 is provided to retain them and prevent them from falling out of the orifices 46. In turn, the cover 52 is held in place by three stud bolts 53 screwed on to an upper superior 56 forming part of the anchor mechanism 17, which detailed further on hereinafter.

In FIGS. 3A and 7, the studs 48 of the pins 47 are constrained by the corresponding machine-cut slots 51, thereby locking the mandrel 11 against rotation in relation to the combined packing-anchor mechanisms 16-17 (and, hence, relative to the well). The smooth anti-release pins 47 further prevent relative rotation between the tool ends, that is between the subs 12 and 13, thereby conveying greater reliability to connection and rotation operations on the upper and lower tubing components during mounting at the mouth of the well and later run-in.

When the piston 18 advances downwards to activate tool setting, the axial downwardly displacement of the seal-holder collar 41 moves the studs 48 of the pins 47 out of these slots 51, as seen in FIGS. 3B and 8, such that they now have room to turn on the mandrel 11. As described further hereafter, the release movement is based on a rotation of the mandrel 11 relative to the combined mechanism 16-17, such that the smooth pins 47 prevent accidental occurrence of the release turning movement if the tool has not been previously set. This means that reliability against accidental release depends no more on a single shear-pin release system such that pressure variations which appear either inside or outside the tubing do not affect proper operation of the anchor slips nor of the packing seals mechanisms 16-17 any more.

FIG. 4A shows the mechanism 17 of the packer tool for anchoring the tool, comprising: upper and lower cones 56 and 57, individually slidable axially downwards to respectively activate tool setting and release, anchor slips 58 equi-circumferentially distributed around the mandrel 11 and slidable on ramps 59 machine-cut in the cones 56 and 57, and a slips cage 61 with individual windows 62 through which the anchor slips 58 may project. This 5½" diameter tool set forth herein by way of example has three anchor slips 58 arranged at 120° from one another around the mandrel 11 although larger tools may have four or five anchor slips 58. Each anchor slip generally has a pair of horizontal and parallel teeth sets 63 with sharp edges 64 that bite into the casing wall in the set position and hold the tool fast. Each set 63 spans an outer cylindrical face measuring 60 mm×46 mm on a slip member 66 (alphabetical suffices A, B . . . are omitted when the reference is general), each pair of members 66 of a given slip 58 being longitudinally spaced from and joined to one another by a bridge 67, all integrated into a single slip piece made of cemented SAE 8620 steel.

The anchor slips 58 are initially retracted inside the cage 61 where they are protected during the run-in. The setting operation involves pushing the anchor slips 58 out of the windows 62 to contact the casing wall. In spite of precautions, the anchor slips 58 may suffer damage anyway from different excessive mechanical or thermal conditions to which the tool is exposed during the run-in and, specially, during the lengthy period it dwells inside a well.

Failure of an anchor slip 58 may cause its teeth 64 to lose grip on the casing wall and the broken anchor slip to fall back inwards. The eventual loss of contact of an anchor slip 58 loosens the pressure of the remaining anchor slips on the casing wall, which may eventually lead to ineffectual setting of the tool.

Figure 9:
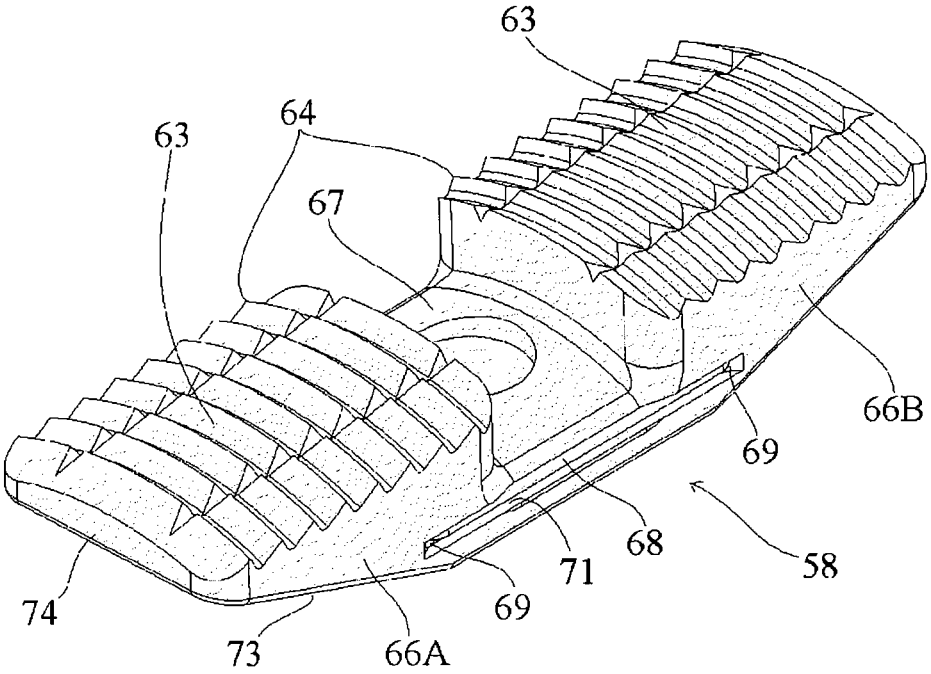
FIG. 9 is a perspective view of an anchor slip unit with an anti-fracture device according to the present invention.

To prevent this event, according to a feature of the present invention, a pair of external linkage means 68 separate from the bridge 67 and having different structural and mechanical properties are placed along each side of each anchor slips 58 and its end are connected to slip members 66 as shown in FIG. 9. Each link 68 is a steel bar 68 of stainless steel—such as SAE 1020—for greater ductility, having a cross-section of 2 $mm^2$ and its ends are bent 90° and inserted in holes 69 made in each slip member 66. The sidewalls of the slips 58 have grooves 71 for housing the linkage bars 68 and keep them in the holes 69 of the anchor slips 58. In this way, the cemented steel material contributes its typical hardness to anchor slips 58 and the external linkage bars 68 relative ductility less prone to failure from jarring and thermal excursions which may fracture an anchor slip 58.

The bridges 67 of the slips 58 are not thermally treated and hence remain ductile. First, the entire piece 58 is cemented, then only the region of the teeth 63 is induction- or flame-heated and the entire piece 58 is tempered. In this way, the slips 58 are hard in the region of the teeth 63 and ductile in the region of the bridge 67 so that, in spite of the latter being the narrower part of the piece 58, a fracture is more likely to occur in the region of the slip members 66. As a result, should a substantial part of an anchor slip 58 fracture, the bars 68 will keep the members 66 linked together preventing the broken part from separating. This provides a two-fold advantage of keeping the slip members 66 together and avoiding a big broken slip part from getting in the way of tool operations such as preventing the tool from setting properly. In addition, the loose insertion of the linkage bar 68 ends in the slips member holes 69 provides some articulation as opposed to the rigidness of the bridge 67 connection.

Resuming the description of the setting operation, the pressure inside the hydraulic chamber 22 generates two opposing forces, one upwards and the other downwards. The former acts on the hydraulic cylinder 19, pushing it upwards, and the downward force on the hydraulic piston 18, urging it downwards. These opposing forces shear the safety pins 26 and enable the hanger cap 21 and the hydraulic cylinder 19 to lift. The annular segments 31 are thereby free to leave the slot 32 in the mandrel 11, unrestraining the piston 18. As the piston 18 starts sliding downwards driven by the pressure in the hydraulic chamber 22, after the three ring segments 31 have been freed as shown in FIG. 2B, it pushes the rubber seals 38 downwards. Before deforming substantially as shown in FIG. 3B, the seals 38 transmit this force via a lower calibrating ring 72 to the upper cone 56 which, in turn, forces the slips 58 outwards in a direction perpendicular to the tool axis. This is as a result of the direction of movement being changed from axial to radial by the upper cone 56 wedging under the upper members 66A of the slips 58 which have an inner surface 73 in the shape of a curved ramp. The radial slip expansion continues until it reaches the inner diameter of the casing with a force that sets the packer tool in the position depicted in FIG. 4B. A wedge-shape 74 formed on the lower slip member 66B is concurrently forced up a cylindrical ramp 76 on the lower cone 57 and also assists in pushing the slips 58 outwards. The lower cone 57 is provided with three stops 77 spaced equicircumferentially on its bottom edge which abut against three snugs 78 formed on the surface of the mandrel 11. In the preferred embodiment, the cone ramps 73 y 76 and the slip 66 wedges have inclinations of approximately 20° relative to the axial direction and the snugs 78 define an imaginary outer diameter of 82.5 mm. Once the slips 58 are set, the upper cone 56 may descend no more such that the entire axial force from the still down-moving piston 18 now compresses the seals 38, expanding their diameters and causing them to seal against the casing.

Figure 10:
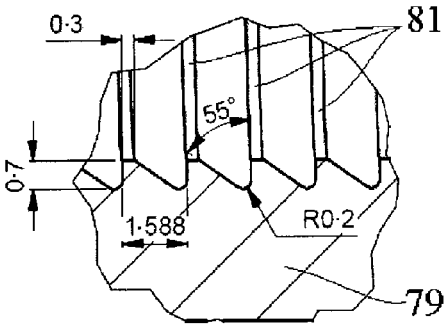
FIG. 10 is a magnified detail of a ratchet tooth impeding retreat of the packing device in FIG. 3B.

As the piston 18 moves down it also drives an open ring 79 downwards. The open ring 79 is provided with sawtooth-like inside teeth 81 which mesh with matching ratchet teeth 82 carved on the mandrel 11 in the path of the ring 79. The meshing teeth 81-82 which define a ratchet are formed by reverse-tap screws having 16 threads per inch (pitch=1.588 mm) on the ring segment 79 and the mandrel 11. FIG. 10 illustrates the geometry and dimensions in millimeters of the anti-retreat teeth 81 formed on the ring segment 79. This ratchet prevents the piston 18 from retreating back up and enables the tool to remain properly set and sealed once the hydraulic chamber 22 has depressurized, hydraulically isolating the upper and lower parts of the tool. FIG. 2C indicates the end positions of the lowered piston 18 and of the raised hydraulic cylinder 19 after the fluid has evacuated the chamber 22.

As with the upper calibrating ring 28, the dimensions of the lower calibrating ring 72 can be adapted to individual well conditions.

Accordingly, in this preferred embodiment, the setting mechanism—the first fundamental operation in a useful cycle of a tool of this type—essentially comprises the hydraulic chamber 22, the hydraulic cylinder 19, the piston 18, the joining member 29 with its calibrating ring 28, the three rubber packer seals arranged about the seal-holder collar 41 of the packing mechanism 16, the cylindrical cover 52, the upper cone 56 and the three anchor slips 58.

The second fundamental operation in the tool cycle is release, which consists in moving the lower cone 57 retained by the snugs 78 downwards to allow retraction of the anchor slips 58 and the rubber packer seals 38. Tool release begins by effectively rotating the tubing 60° to the right. The necessary torque for the mandrel 11 to rotate is given by the number of shear pins 83 screwed into the lower sub 13 which holds the mandrel 11 fast to the lower cone 57 and the lower sub 13.

Figure 11:
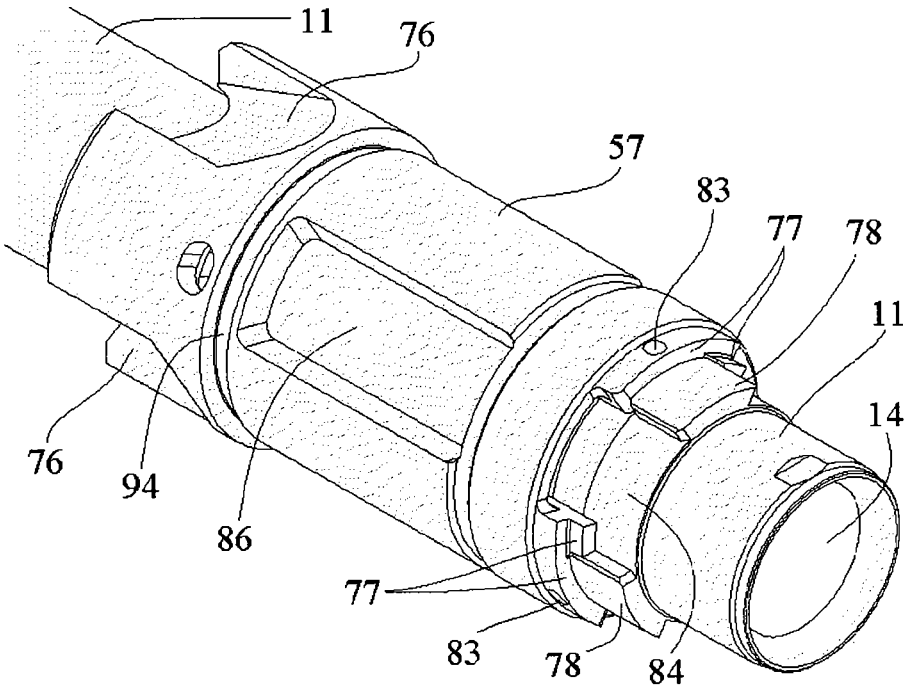
FIG. 11 is a perspective view showing the geometry of the lower cone without slips and the bottom part of the mandrel that come into play for the release movement of the mandrel, and also showing the anti-resetting mechanism.

The release torque applied to the mandrel 11 from above the well first shears the safety pins 83 dimensioned to break when subject to the release torque, thereby enabling the mandrel 11 to turn inside the lower cone 57 thereby displacing the mandrel snugs 78 from their position against the stops 77 of the lower cone 57, as may also be seen clearly in FIG. 11, to a position where the stops 77 face spaces 84 formed between the mandrel snugs 78, enabling the lower cone 57 to drop about 130 mm (5") together with the lower sub 13, sliding along the mandrel 11 to thereby trigger quick release of the tool. The guide snugs 78 of the jay 86, which come out from their locking position during setting and are guided down the slots 84 cut out in the lower cone 57 to their release position, do so without torsionally uncoupling the mandrel 11 from the lower sub 13, thereby maintaining release control over the tool torque throughout the tool.

During the downward displacement of the lower sub 13, a notch 87 is uncovered in the jay 86 of the lower cone 57, allowing pressures to equalize inside the tool and in the annular spacing. This situation enables forced circulation of clean fluid between the tubing and the annular, and towards the surface to wash the length of the tool.

The lower cone 57 has a step 88 which, as the cone 57 slides down the mandrel 11, strikes a complementary step 89 formed in its path on the slips cage 61, dragging it down together with the anchor slips 58. As the lower cone 57 descends, the anchor slips 58 loose their foothold on the lower cone 57 and slide along the ramp 76 thereof allowing the anchor slips 58 to retract again against the mandrel 11. The packer thus becomes unset from the casing. The upper cone 56 also descends a short distance, enough to decompress the rubber packer seals 38, such that the radial length increases again at the expense of a diminishing diameter and become unsealed. The tool is thus fully released regarding both the anchor and packing mechanisms 16-17.

Since pressure conditions down the borehole as well as mechanical friction during tool extraction could push the lower cone 57 back upwards after release, spontaneously resetting the tool sufficiently to impede extraction or otherwise make it more difficult, a restrainer is provided against eventual retreat of the release mechanism. The release mechanism essentially comprises the lower cone 57 and associated means that control and participate in the downward movement just described hereinbefore. This restrainer prevents the lower cone 57 from sliding upwards back along the mandrel 11 thereby avoiding another setting post tool release. The anti-post-release-resetting restrainer comprises an expansible ring 91 around the mandrel 11 housed inside a small triangular recess in the inner surface of the lower cone 57 to define a transversal step 93. When the cone 57 slides downwards, it drags the restrainer ring 91 down with it until the latter lodges in a circumferential notch 94 formed on the wall of the mandrel 11, as FIG. 4C illustrates, transforming the ring 91 into a safety lock which prevents the lower cone 57 from being able to move back up again under any circumstance once the ring 91 penetrates the notch 94. Hence, the tool may be reliably handled once released.

In this preferred embodiment, the restrainer ring 91 is about 4 mm thick and about 8 mm wide whereas the depth of the notch 94 reduces this part of the diameter of the mandrel 11 down to about 67 mm (2.6"). This measurement is a trade-off between the need of sufficient notch depth to catch the ring 91 without unduly weakening the wall thickness of the mandrel 11.

As in the setting maneuver, the complementary steps 88-89 become axially apart as illustrated by FIG. 4B and meet again as the lower cone 57 comes down in a manner which sometimes may be hard enough to fracture the anchor slips 58. As mentioned hereinbefore, broken slips bits are a risk factor which may interfere with the release process. According to an aspect of the present invention, a buffer or damper means formed by a rubber ring 96 is located between the pair of steps 88-89. Preferably, the ring 96 is made of acryl-nitrile D-90 and has a square or rectangular cross-section of about 6.7 mm wide and about 94.3 mm and about 105 mm inner and outer diameters, respectively.

Describing the anchor slips 58 in greater detail, FIG. 10A exhibits a typical, bidirectional anchor slip 58 having gripping teeth 64 shaped in a triangular cross-section slanted towards a preferred orientation, i.e. like a saw-tooth, in order to oppose substantial frictional resistance against a prevailing axial direction against the casing of the well, compared to the opposite direction. In each typical anchor slip 58, the preferred slant direction of the teeth 64 of one set 63 is opposite to the other so as to maximize the tool setting power against the casing wall by virtue of both sets of oppositely slanted teeth 63 forming part of the same rigid piece 58. In the embodiment illustrated in FIGS. 4A, 4B and 4C, the upper teeth 63 are set against descent and the lower teeth 63 against ascent.

Figure 12A:
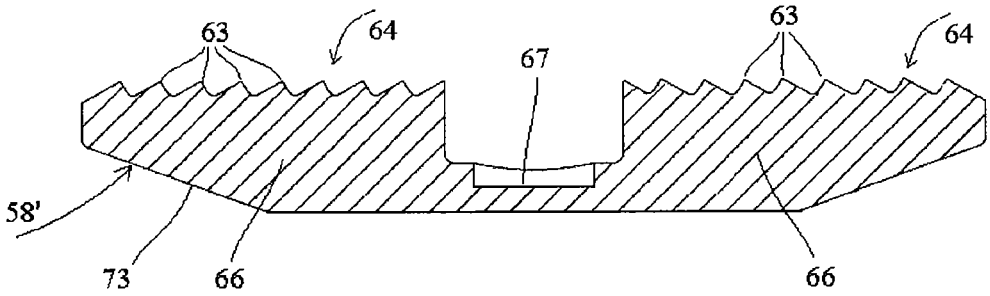
FIG. 12A is a cross-section of a typical bidirectional symmetrical anchor slip.
Figure 12B:
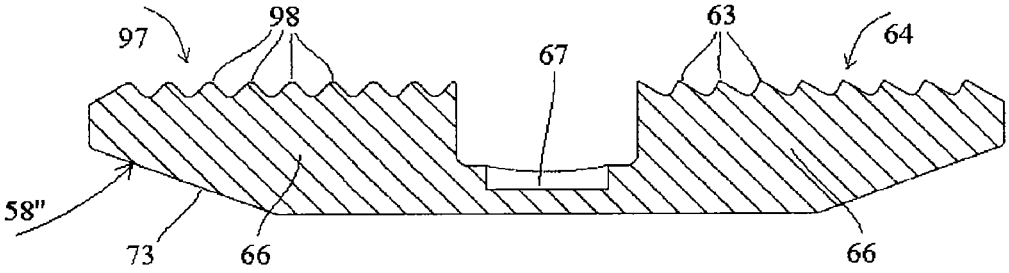
FIG. 12B is a cross-section analogous to FIG. 12A of an asymmetrical anchor slip having one set of typical teeth and one set of dummy teeth.

One (and most preferably not more than one) of the anchor slips 58' comprises unidirectional teeth 64 in one set and "dummy teeth" 97 as the other. The latter are characterized by blunt rather than sharp edges 64, for instance by termination in rounded edges 98 when compared to the sharp teeth 64 of the rest of the anchor slips 58. In addition, the "dummy teeth" 97 furthermore lack a preferred orientation of the teeth 97, rather they are symmetrical, i.e. not slanted, as FIG. 12B shows, in contradistinction to the typical teeth 64 with a preferred orientation shown un FIG. 12A. I estimate that the radius of the cylindrical curvature of the rounded edges 98 should not be less than about 0.4 mm, preferably not less than about 0.8 mm, to meet the object of the invention. In other words, the set of dummy teeth 97 opposes scant resistance in either axial direction against sliding along the casing wall.

This overcomes the potential problem of the teeth 64 "merging" or "integrating" with the casing after a long period of being together in the same biting position. What happens is that, as an anchor release operation begins, the typical set of teeth 64 which partner the set of dummy the teeth 98 becomes unstuck freely and separates from the casing promoting immediate collapse of the typical-dummy pair 58' such that this slip releases first. The loss of a bearing point of the packer tool provides a degree of freedom for transversal movement of the tool to release the two remaining anchor slips 58 with no difficulty.

On the other hand, the "dummy" teeth 98 carry out a secondary function by applying a radial force on the casing wall which balances out the radial forces exerted by the "typical" teeth 64 angled at 20°.

These features convert the packer of the present invention into an efficient and reliable tool during run-in, setting and release, applicable to well completions requiring lowering, affixing and recovering multiple packers in a single voyage of the tubing, such as in water injection and in hydrocarbon production installations. The mandrel 11 in combination with the lower sub 13 may function as a telescopic joint assuring that movements applied to a particular tool which is being operated are not transmitted to tools located therebelow.

A particular embodiment of the invention has been disclosed herein, however changes in materials, shapes, sizes, geometry and arrangement of tool components may be carried out without departing from the purview of the present invention as set forth in claims that follow. For instance, a packer tool having a nominal diameter of 7" or 9⅝" may comprise more than three slips.

What is claimed is:

1. A packer tool for a well comprising a mandrel and an anchor mechanism comprising a plurality of slips mounted about the mandrel, each slip comprising two members spaced vertically apart and rigidly joined by a bridge portion of the slip, each slip member further comprising an outer face with a plurality of teeth formed thereon for anchoring in said well when said tool is in a set position, said slip bridge portion being of the same material as said slip members and integrated therewith in a single piece, and each slip further comprising an external linkage device separate from said slip bridge portion and linking both said slip members in order to keep the members joined in the event of the slip fracturing while down in said well.

2. The tool of claim 1, wherein said external linkage is made of a material more ductile and less hard than the slip material.

3. The tool of claim 1, wherein said two slip members and said bridge portion of each slip are integrated into a single piece of cemented steel and said external linkage means are of stainless steel.

4. A packer tool for a well comprising a mandrel and an anchor mechanism comprising a plurality of slips mounted about the mandrel, each slip comprising two members spaced vertically apart and rigidly joined by a bridge portion of the slip, each slip member further comprising an outer face with a plurality of teeth formed thereon for anchoring in said well when said tool is in a set position, said slip bridge portion being of the same material as said slip members and integrated therewith in a single piece, and each slip further comprising an external linkage device separate from said slip bridge portion and linking both said slip members in order to keep the members joined in the event of the slip fracturing while down in said well;

wherein said linkage device comprises at least one bar extending alongside said slip bridge portion and having two ends respectively connected to said two slip members.

5. The tool of claim 4, wherein said linkage device comprises two bars extending at either side of said bridge portion.

6. The tool of claim 4, wherein said slip members have sidewalls with holes therein and said two bar ends are each bent transversally and inserted in respective ones of said slip member holes.

7. The tool of claim 6, wherein said holes are located away from said toothed member surfaces so as not to interfere with slip movement.

8. The tool of claim 6, wherein said slip has a groove in each sidewall thereof extending between said holes in said two slip members for housing said linkage bars.

9. The tool of claim 4, said anchor mechanism comprising a cage, a setting actuator cone and a release actuator cone both individually slidably mounted to said mandrel, and plurality of slips able to project through said cage, said cones having each ramp portions and each slip comprising two wedge-shaped portions which slidably bear on respective ones of said cone ramp portions, wherein said release cone comprises an outwardly extending step and said cage comprises an inwardly extending step located in the path of said cone step when said release actuator cone slides along said mandrel during a release operation to contact said cage step and drag it together with said slips to a release position, said tool further comprising a buffer element in said path to dampen said contact between said release actuator cone and said cage with said slips, wherein said buffer element comprises a ring of resilient material.

10. The tool of claim 9, wherein said buffer element comprises a rubber ring.

11. The tool of claim 9, wherein said buffer element is located on said release actuator cone.

12. The tool of claim 11, wherein said release actuator cone comprises a circumferential groove under said ramp portions thereof and said buffer element comprises a ring of resilient material lodged in said groove.

13. The tool of claim 9, wherein said release actuator cone and said cage are metallic.

14. A slip for a packer tool for use in a well, the slip comprising two members spaced vertically apart and rigidly joined by a bridge portion of the slip, each slip member comprising an outer face with a plurality of teeth formed thereon for anchoring in said well when said tool is in a set position, said slip bridge portion being of the same material as said slip members and integrated therewith in a single piece, wherein said slip further comprises an external linkage device separate from said slip bridge portion and linking both said slip members in order to keep the members joined in the event of the slip fracturing while down in said well.

15. A slip for a packer tool for use in a well comprising two members spaced vertically apart and rigidly joined by a bridge portion of the slip, each slip member comprising an outer face with a plurality of teeth formed thereon for anchoring in said well when said tool is in a set position, said slip bridge portion being of the same material as said slip members and integrated therewith in a single piece, wherein said slip further comprises an external linkage device separate from said slip bridge portion and linking both said slip members in order to keep the members joined in the event of the slip fracturing while down in said well said linkage device comprising at least one bar extending alongside said slip bridge portion and having two ends respectively connected to said two slip members.

16. The slip of claim 15, wherein said linkage device comprises two bars extending at either side of said bridge portion.

17. The slip of claim 15, wherein said slip members have sidewalls with holes therein and said two bar ends are each bent transversally and inserted in respective ones of said slip member holes.

18. The slip of claim 17, wherein said holes are located away from said toothed member surfaces so as not to interfere with slip movement.

19. The slip of claim 17, wherein said slip has a groove in each sidewall thereof extending between said holes in said two slip members for housing said linkage bars.

20. The slip of claim 15, wherein said bars are made of a material more ductile and less hard than the slip material.

21. The slip of claim 15, wherein said two slip members and said bridge portion of each slip are integrated into a single piece of cemented steel and said bars are of stainless steel.

* * * * *